US008833248B2

(12) United States Patent
Skakal et al.

(10) Patent No.: US 8,833,248 B2
(45) Date of Patent: Sep. 16, 2014

(54) INTERIOR SUPPORT ASSEMBLY AND METHOD FOR PROVIDING INTERIOR SUPPORT TO A TARGET OBJECT BEING PRINTED UPON

(75) Inventors: Todd Skakal, Lancaster, NY (US); William Elliott, Alden, NY (US); Daniel Destino, North Tonawanda, NY (US); Doug Samuel, North Reading, MA (US)

(73) Assignee: Illinois Tool Works Inc., Glenview, IL (US)

( * ) Notice: Subject to any disclaimer, the term of this patent is extended or adjusted under 35 U.S.C. 154(b) by 132 days.

(21) Appl. No.: 13/485,259

(22) Filed: May 31, 2012

(65) Prior Publication Data

US 2013/0319274 A1 Dec. 5, 2013

(51) Int. Cl.
*B41F 17/28* (2006.01)

(52) U.S. Cl.
USPC ..... 101/35; 101/38.1

(58) Field of Classification Search
CPC ..... B41F 17/28; B41F 17/006; B41F 17/002
USPC ..... 101/407.1, 35, 38.1, 39, 40, 40.1, 42, 101/43, 44
See application file for complete search history.

(56) References Cited

U.S. PATENT DOCUMENTS

| | | | | | |
|---|---|---|---|---|---|
| 2,425,928 | A | * | 8/1947 | Emerson | 101/40.1 |
| 3,089,414 | A | * | 5/1963 | Jenkins | 101/124 |
| 4,235,579 | A | * | 11/1980 | Kurz et al. | 425/174.4 |
| 4,282,806 | A | * | 8/1981 | Lala | 101/38.1 |
| 2002/0097315 | A1 | * | 7/2002 | Aroneo et al. | 347/215 |

OTHER PUBLICATIONS

Title: Fante's Kitchen Wares Shop, URL: http://fantes.com/coffee-manualdrip.html and http://www.fantes.com/images/120291coffee_manualdrip.jpg, Date: Feb. 13, 2008, Pertinent pages: p. 4 and last page.*

* cited by examiner

*Primary Examiner* — Matthew G Marini
*Assistant Examiner* — Ruben Parco, Jr.
(74) *Attorney, Agent, or Firm* — Christopher R. Carroll; The Small Patent Law Group LLC

(57) ABSTRACT

A support assembly includes a lid, a plug body, and a conduit. The lid engages a target object having an exterior surface on which an image is to be printed. The plug body is disposed in an interior volume of the target object when the lid is engaged with the target object. The plug body engages an interior surface of the target object to form a sealed chamber inside the target object. The conduit extends through the lid to an orifice disposed between the lid and the plug body. The conduit delivers a pressurizing fluid into the sealed chamber in order to increase a pressure inside the sealed chamber in the target object. The pressure inside the sealed chamber provides a resistive force that prevents the exterior surface of the target object from changing shape when the image is printed on the exterior surface of the target object.

17 Claims, 11 Drawing Sheets

INTERIOR SUPPORT ASSEMBLY AND METHOD FOR PROVIDING INTERIOR SUPPORT TO A TARGET OBJECT BEING PRINTED UPON

BACKGROUND

A variety of printing systems can apply or print images (e.g., graphics, text, or the like) on exterior surfaces of objects. Many of these systems directly engage or contact the exterior surfaces on which the images are printed. For example, heat transfer printing, ink jet printing, and the like, can involve contact between the source of the image (e.g., a web having images to be thermally transferred, a print head, or other components) and the surface of the object on which the images are printed. For some objects that are flexible or non-rigid, such as plastic bodies having relatively flexible surfaces (e.g., plastic flower pots), printing on the surfaces of these surfaces can impart forces on the surfaces and cause the surfaces to become deformed. For example, the surfaces may be bent, indented, and the like, to cause the surfaces to become at least partially concave. Because the printing system is typically designed to print on non-deformed surfaces, the deformation of the surfaces can result in the image not being successfully applied to the surfaces.

BRIEF SUMMARY

In one embodiment, a support assembly for a printing system that prints on hollow objects includes a lid, a plug body, and a conduit. The lid is configured to engage a target object having an exterior surface on which an image is to be printed. The plug body is coupled with the lid and configured to be disposed in an interior volume of the target object when the lid is engaged with the edge of the target object. The plug body also is configured to engage an interior surface of the target object to form a sealed chamber inside the target object when the lid engages the target body. The conduit extends through the lid to an orifice disposed between the lid and the plug body. The conduit is configured to deliver a pressurizing fluid into the sealed chamber in order to increase a pressure inside the sealed chamber in the target object. The pressure inside the sealed chamber provides a resistive force that prevents the exterior surface of the target object from changing shape when the image is printed on the exterior surface of the target object.

In another embodiment, a method (e.g., for printing on a hollow object) includes receiving a target object having an exterior surface on which an image is to be printed, inserting an interior support assembly into an interior volume of the target object until the interior support assembly engages the target object in a plurality of locations to form a sealed chamber inside the target object, and delivering a pressurizing fluid into the sealed chamber inside the target object in order to increase a pressure inside the sealed chamber. The pressure inside the sealed chamber provides a resistive force that prevents the exterior surface of the target object from changing shape when the image is printed on the exterior surface of the target object.

In another embodiment, a support assembly includes a lid, a piston, and a plug body. The lid is configured to engage a target object having an interior volume that is at least partially enclosed by a wall of the target object. The piston is coupled with the lid. The plug body is coupled with the lid by the piston and is configured to engage an interior surface of the wall of the target object inside the interior volume. At least one of the lid or the plug body is used to create a resistive force on the wall of the target object that prevents a shape of the wall from changing during printing of an image on an exterior surface of the wall.

BRIEF DESCRIPTION OF THE DRAWINGS

Reference is now made briefly to the accompanying drawings, in which.

DETAILED DESCRIPTION

One or more embodiments of the inventive subject matter described herein relate to systems and methods for printing on hollow bodies. The printing may involve contact printing where physical contact or engagement is made between the bodies being printed upon (e.g., referred to herein as "target bodies") and a source of the images, designs, text, and the like, that is being printed on the target bodies. For example, the printing may involve heat transfer printing where a web or sheet including a wax transfer print of an image (as used herein, the term "image" may refer to graphics, text, and the like) is placed in contact with an exterior surface of the target body and the image is transferred from the web to the target object by application of heat. In one embodiment, the target object may be hollow in that the target object has both an exterior surface and an opposite interior surface. When the target object is printed upon (e.g., when the exterior surface is printed upon), the exterior surface may be supported from within the target body to provide structural support during the printing of the image onto the exterior surface. For example, the support may resist pushing in on the exterior surface during printing so that the exterior surface can maintain a constant or generally constant shape during printing.

Figure 1:
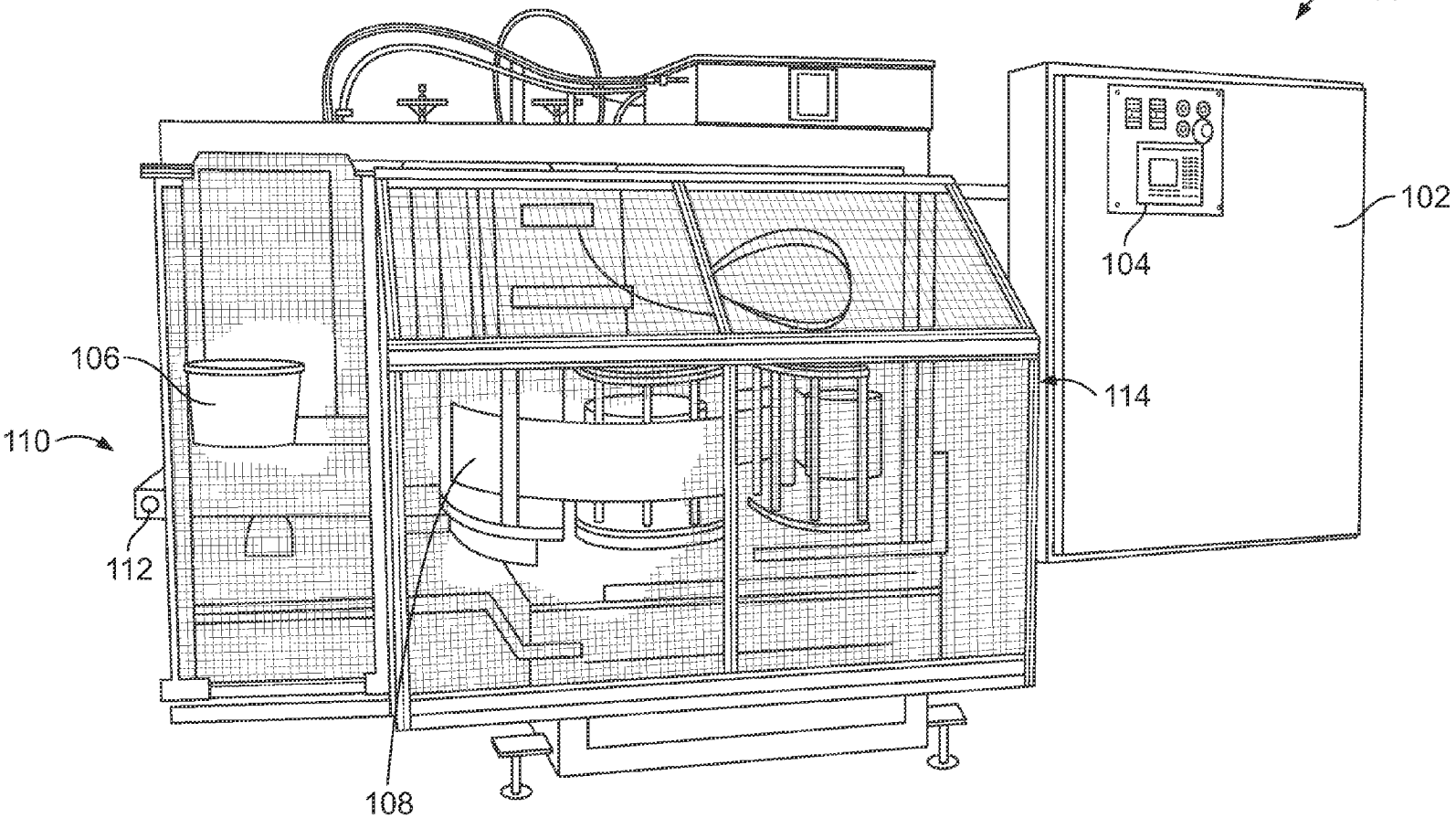
FIG. 1 is a perspective view of one embodiment of a printing system.

FIG. 1 is a perspective view of one embodiment of a printing system 100. The illustrated printing system 100 is a heat transfer system that prints images on exterior surfaces of target objects 106 using heat transfer of images from a web 108 to the exterior surfaces of the target objects 106. While the target objects 106 shown and described herein are containers (e.g., flower pots and the like), alternatively, the target objects may be another type of object that can have structural support provided during printing on the object.

The system 100 includes a control unit 102, such as one or more processors, controllers, and the like, that monitor and/or control operations of the system 100. The control unit 102 may operate based on one or more sets of instructions stored on a tangible and non-transitory computer readable medium, such as an internal or external computer memory. The control unit 102 includes an operator interface 104 that allows a human operator to control the system 100.

The target objects 106 can be loaded into the system 100 at an inlet 110 and carried through the system 100 by a conveyance and support assembly 112 (also referred to herein as "conveyance assembly"). As the target objects 106 move through the system 100, the web 108 may be brought into contact (e.g., physical engagement) with, or in close proximity to, the exterior surfaces of the target objects 106. A print on the web 108 may be transferred to the target objects 106 to print the images onto the target objects 106. For example, the web 108 may represent a continuous roll of a wax transfer print having several images for transferring onto the target objects. By "continuous," it is meant that the web 108 may be elongated between opposite ends and have several copies of the same or different images for printing on one or more separate target objects 106 between the opposite ends. Alternatively, the web 108 may represent another carrier of images for being printed onto the target objects. In another embodiment, the web 108 may represent a print head that engages the exterior surfaces of the target objects 106 to print (e.g., using ink jet or other techniques) on the target objects 106.

During printing of the images onto the target objects 106 from the web 108, the system 100 supports the target objects 106 from within. For example, the system 100 may insert an interior support assembly (shown and described below) into an interior volume (shown and described below) of the target object 106. Using this interior support assembly, the system 100 can support the target object 106 from within to prevent the exterior surface of the target object 106 from changing shape (e.g., becoming indented, concave, or the like) during printing. The system 100 can then remove the interior support assembly from the target object 106 so that the target object 106 can continue to move through the system 100 and be removed from the system 100 via an outlet 114.

Figure 2:
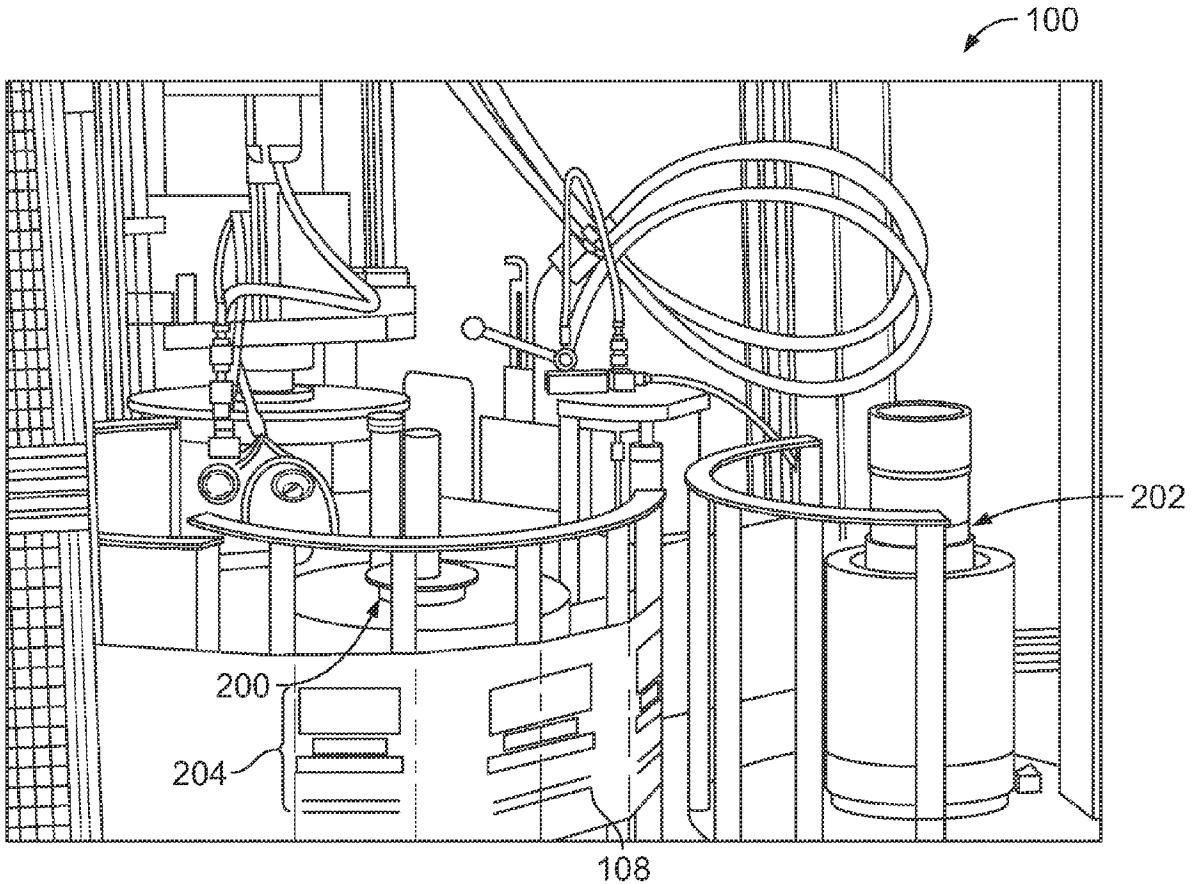
FIG. 2 illustrates a perspective view of a web of images loaded in the printing system shown in FIG. 1 in accordance with one embodiment.

FIG. 2 illustrates a perspective view of the web 108 loaded in the system 100 in accordance with one embodiment. The system 100 can include spindles 200, 202 on which the web 108 is disposed. A web 108 that includes images 204 to be printed on the target objects 106 (shown in FIG. 1) may be rolled around a tube or other body that is placed onto the supply spindle 200. The spindle 200 is referred to as a "supply" spindle because the spindle 200 holds the portion of the web 108 that has not yet been used to print on the target object 106. The web 108 may be positioned to extend around one or more rollers or other components of the system 100 so that the web 108 is positioned at or near a location where the target objects 106 move during the printing operation. During printing, the images on the web 108 are transferred onto the target objects 106 (e.g., using heat transfer techniques). The web 108 continues through one or more other rollers or other components to the collection spindle 202. The spindle 202 is referred to as the "collection" spindle because the spindle 202 collects the portion of the web 202 that has been used for printing on the target objects 106.

During operation, the web 108 may be unrolled from the supply spindle 200, extend through the system 100 to the location of a target object 106. As described below, the target object 106 and the web 108 may be moved relative to each other while printing occurs to transfer the image on the web 108 to the target object 106. The web 108 may continue to move through the system 100 and be wound up on the collection spindle 202. When printing is complete and/or no additional images remain on the web 108, the web 108 can be removed from the collection spindle 202 and another web 108 can be placed on the supply spindle 200.

Figure 3:
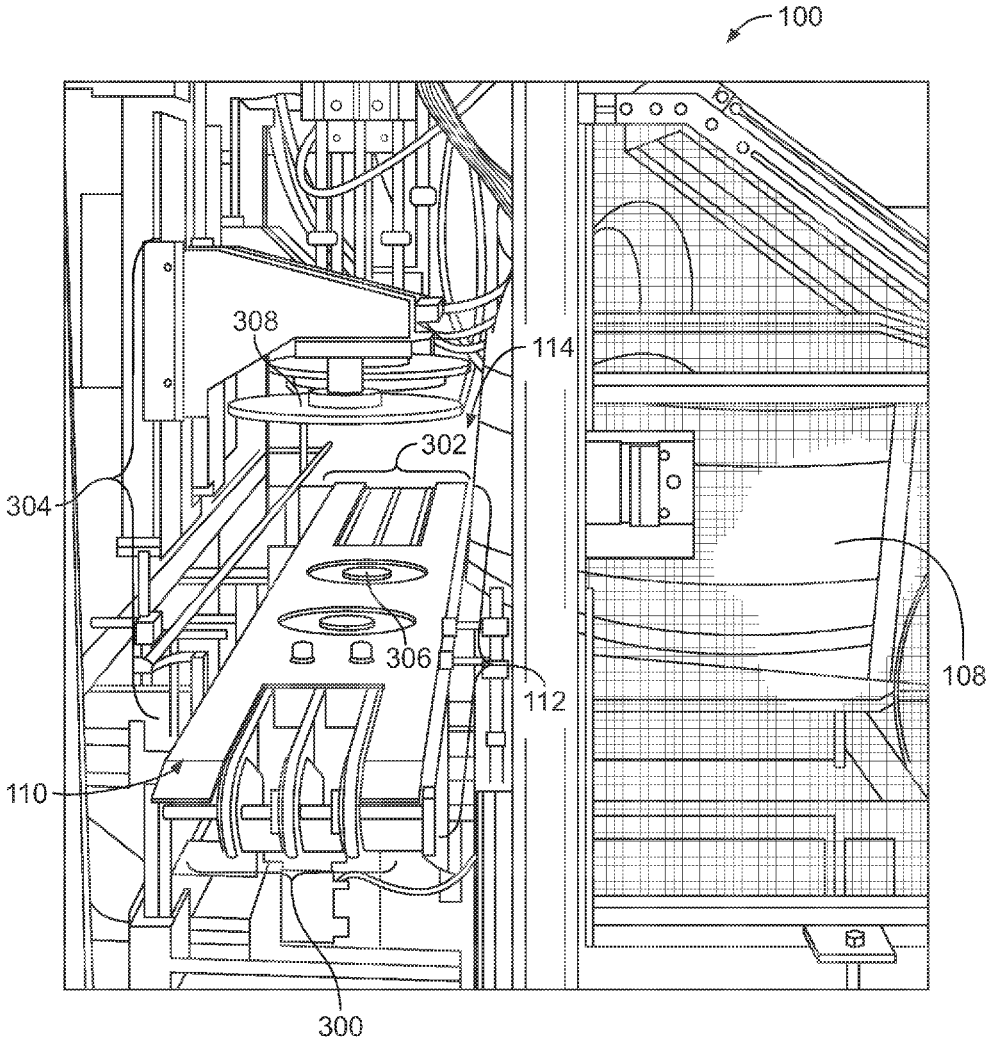
FIG. 3 is a perspective view of one embodiment of a conveyance and support assembly shown in FIG. 1 in the printing system.
Figure 4:
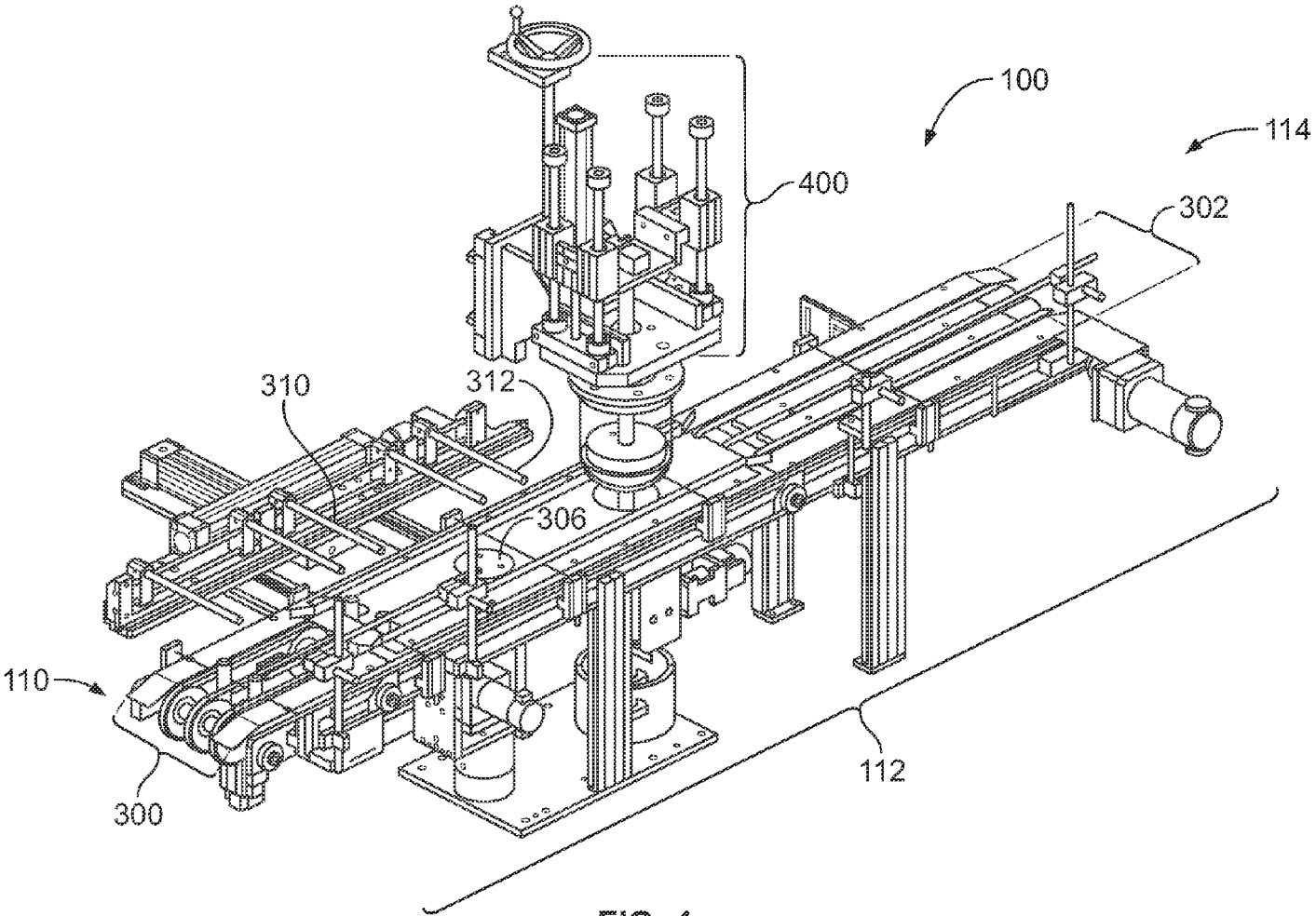
FIG. 4 is another perspective view of one embodiment of the conveyance and support assembly.

FIG. 3 is a perspective view of one embodiment of the conveyance assembly 112 in the system 100. FIG. 4 is another perspective view of one embodiment of the conveyance assembly 112 in the system 100. In the illustrated embodiment, the conveyance assembly 112 includes conveyors 300, 302 that move the target objects 106 (shown in FIG. 1) into and out of the system 100. For example, the inlet conveyor 300 may receive the target objects 106 from the inlet 110 of the system 100 and move the target objects 106 into the system 100 toward the web 108 for pre-treatment of the exterior surfaces of the target objects 106, printing on the exterior surfaces, and/or post-treatment of the exterior surfaces. After printing and/or post-treatment, the outlet conveyor 302 moves the target objects 106 to the outlet 114 of the system 100. In one embodiment, the conveyors 300, 302 may be a single continuous (e.g., non-segmented) conveyor that extends underneath portions of the system 100 (e.g., a pre-treatment station 304 and a printing station 400 described below) to avoid engagement with a target object 106 but is otherwise positioned to move the target object 106 to the pre-treatment station 304 and away from the printing station 400. Using a single-body conveyor to form the conveyors 300, 302 can assist in moving a series of target objects 106 into and out of the system 100 at a common speed so as to avoid timing problems with using the system 100 to print several target objects 106 in sequence. For example, sequentially moving the target objects 106 into and out of the system 100 can avoid backups of the target objects 106 within the system 100. Alternatively, the conveyors 300, 302 may represent separate conveyors that are not connected with each other.

When a target object 106 is loaded into the system 100 through the inlet 110, the inlet conveyor 300 moves the target object 106 into the system 100. In the illustrated embodiment, the conveyance assembly 112 includes a transfer device 310 that moves the target object 106 from the inlet conveyor 300 to a pre-treatment station 304 (shown in FIG. 3). The transfer device 310 may engage the target object 106 and move the target object 106. For example, the transfer device 310 can include one or more elongated rods that are moved along a track to push the target object 106 to the pre-treatment station 304. Alternatively, other components may engage and move the target object 106.

The pre-treatment station 304 includes a pad 306 that can lift up and/or rotate the target object 106 when the target object 106 is disposed on the pad 306. In one embodiment, the pad 306 receives the target object 106, lifts the target object 106, and rotates the target object 106 while energy is applied to the exterior surface of the target object 106 to increase the surface energy of the target object 106. This energy can include heat (e.g., a flame), corona treatment, or plasma treatment, or some other form of energy. This energy may alter the exterior surface of the target object 106 so the exterior surface can better receive the image from the web 108. For example, applying heat to the exterior surface of the target object 106 can cause the image 204 (shown in FIG. 2) on the web 108 to better adhere to the exterior surface of the target object 106 during the subsequent transfer of the image 204 from the web 108 to the target object 106. In the illustrated embodiment, the pre-treatment station 304 also includes a lid 308 (shown in FIG. 3) that engages and/or rotates the target object 106 in the pre-treatment station 304.

The system 100 moves the target object 106 from the pre-treatment station 304 to a printing station 400 (shown in FIG. 4). For example, the same or another transfer device 312 can engage the target object 106 in the pre-treatment station 304 and move the target object 106 to the printing station 400. The printing station 400 holds the target object 106 for printing of one or more images from the web 108, as described in more detail below. After printing is complete, one or more post-treatment operations may be performed on the target object 106 in the printing station 400 or at a post-treatment station. Such post-treatment operations can include exposing the target object 106 to energy (e.g., flame) to change an appearance of the target object 106 and/or image on the target object 106 (e.g., provide a more glossy appearance to the target object 106), to cure the image on the target object 106, or the like.

After printing and/or post-treatment of the target object 106 are completed, the transfer device 312 (or another component) can move the target object 106 to the outlet conveyor 302. The outlet conveyor 302 may move the target object 106 to the outlet 114 of the system 100, where the target object 106 can be removed from the system 100.

Figure 5:
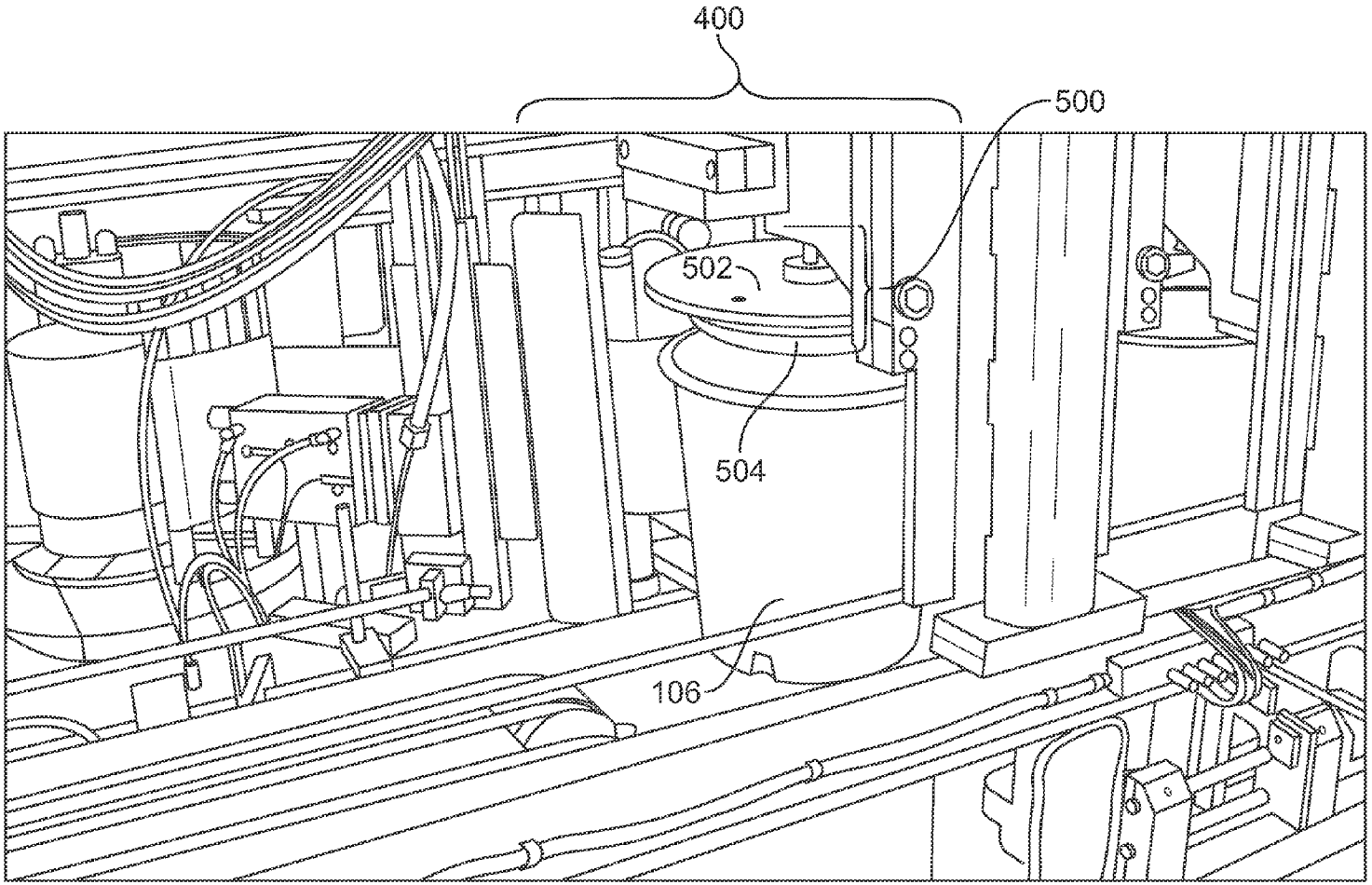
FIG. 5 illustrates a perspective view of a target object in a printing station of the printing system in accordance with one embodiment.

With continued reference to the system 100 as shown in FIG. 4, FIG. 5 illustrates a perspective view of a target object 106 in the printing station 400 of the system 100 in accordance with one embodiment. The printing station 400 includes an interior support assembly 500 that is inserted into the target object 106. The support assembly 500 includes a lid 502 and an interior plug body 504. As described in more detail below, the support assembly 500 can be inserted into the target object 106, such as by lowering the support assembly 500 onto the target object 106. The lid 502 engages the target object 106 at or around the opening through which the support assembly 500 is inserted into the target object 106, such as the upper opening of the target object 106. The engagement between the lid 502 and the target object 106 may form a seal that prevents the flow of fluid (e.g., liquid and/or gas) through an interface between the lid 502 and the target object 106.

Figure 6:
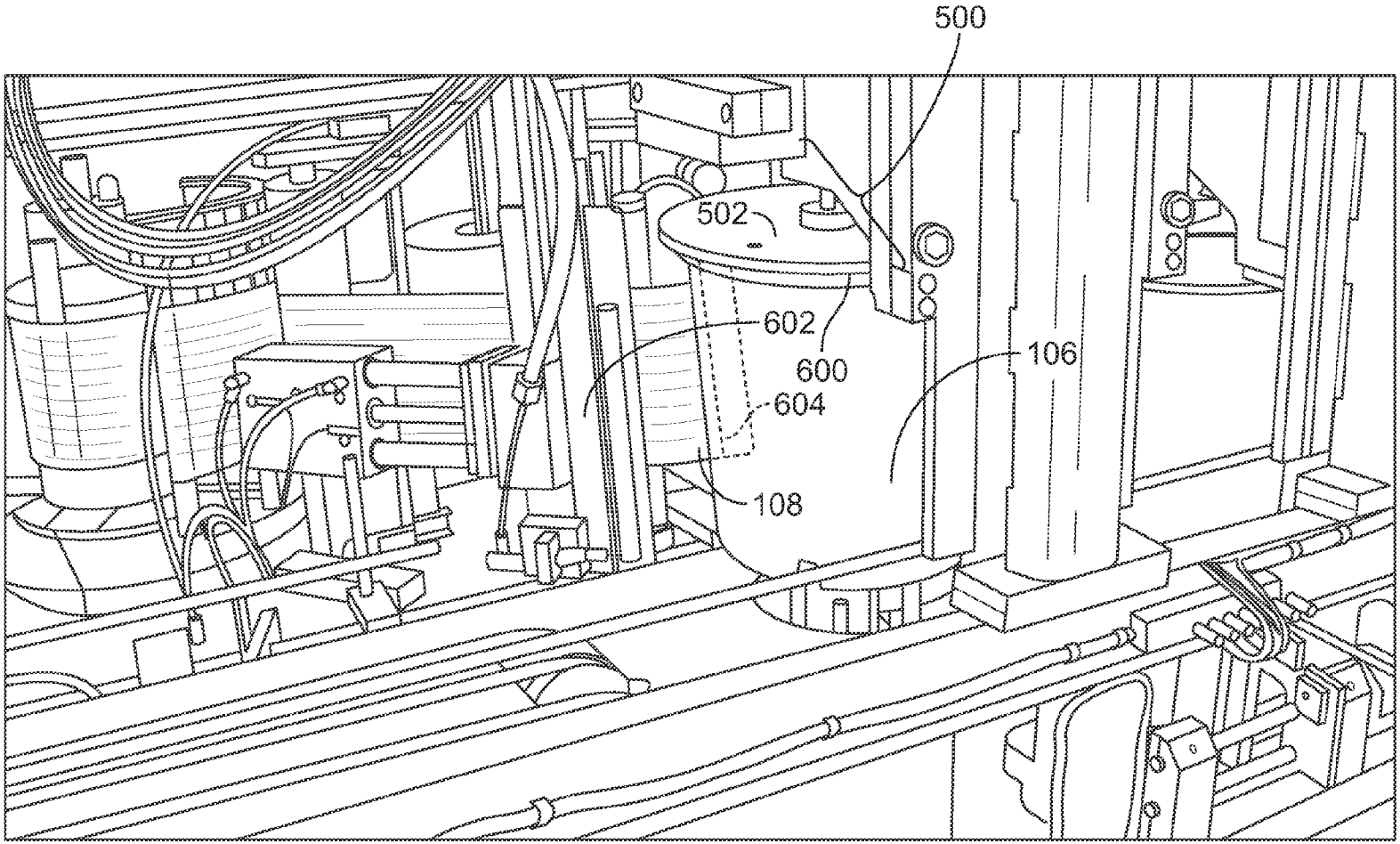
FIG. 6 illustrates a perspective view of a support assembly connected with the target object in accordance with one embodiment.

FIG. 6 illustrates a perspective view of the support assembly 500 connected with the target object 106 in accordance with one embodiment. As show in FIG. 6, the support assembly 500 can be lowered onto the target object 106 such that the lid 502 of the support assembly 500 engages and is sealed to the target object 106. The lid 502 can include a deformable body 600 (e.g., silicone or another material) that engages the target object 106 to create a seal between the target object 106 and the lid 502. When the lid 502 is sealed to the target object 106, the plug body 504 engages the interior surface of the target object 106. As described below, the support assembly 500 may support the exterior surface of the target object 106 during printing on the target body 106. In order to print on the target object 106, the web 108 may be moved past the target object 106 while the target object 106 is rotated, such as by the lid 502 of the support assembly 500 rotating the target object 106. During the rotation of the target object 106 and the movement of the web 108 past the target object 106, an applicator device 604 contacts the web 108 to cause the web 108 to engage the exterior surface of the target object 106. The applicator device 604 shown in FIG. 6 is a roller, such as a cylindrical body that rotates about (e.g., around) a vertical axis). The applicator device 604 presses the web 108 against the target object 106 and applies pressure to the web 108 on the target object 106. In one embodiment, the applicator device 604 is heated and/or another component heats the interface between the applicator device 604 and the web 108 to transfer the image on the web 108 to the target object. The web 108 may contact the target object 106 such that the heat from the heating element 602 causes ink, decals, or other components that form the images on the web 108 to be transferred and/or sealed to the target object 106. For example, the images on the web 108 may be held to the web 108 by an adhesive, such as wax, that releases the images from the web 108 when sufficient heat is applied to the web 108 at or near an interface between the web 108 and the target object 106. As the web 108 passes by the rotating target object 106, the heat can cause the images to separate from the web 108 and adhere to the target object 106.

Subsequent to applying the image to the target object 106, a post-treatment unit 602 can apply heat to the target object 106. The post-treatment unit 602 can generate a flame that changes the surface energy of the target object 106, such as to create a desired glossy appearance to the target object 106. Alternatively, the heat may be applied for one or more other reasons or the post-treatment unit 602 may not be included in the system 100.

Figure 7:
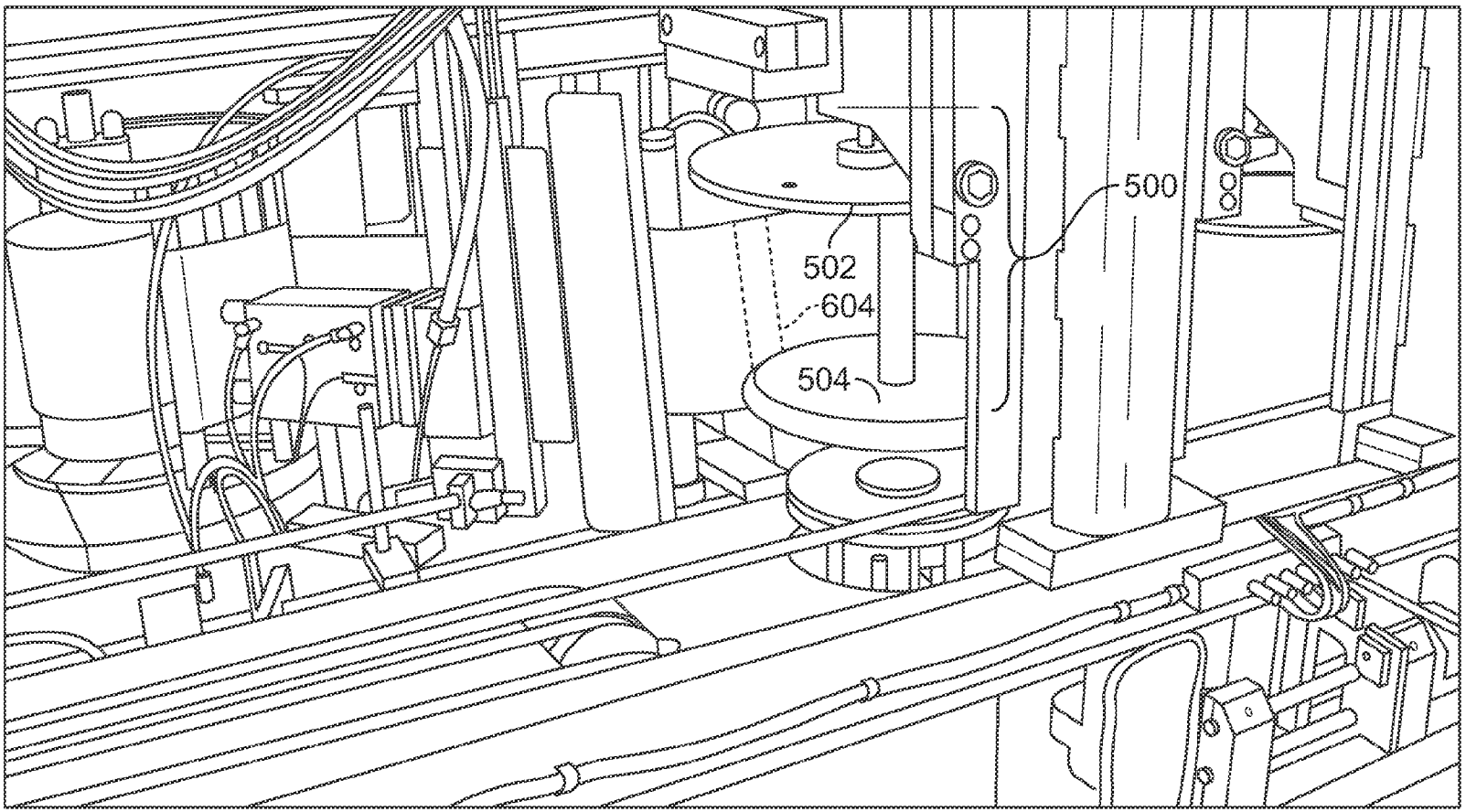
FIG. 7 illustrates another perspective view of the support assembly with a plug body shown in FIG. 5 extended away from a lid shown in FIG. 5 in accordance with one embodiment.

FIG. 7 illustrates another perspective view of the support assembly 500 with the plug body 504 extended away from the lid 502 in accordance with one embodiment. The target object 106 is not shown in FIG. 7. In the illustrated embodiment, the plug body 504 moves away from the lid 502 and into the target object 106 until the plug body 504 contacts the interior surface of the target object 106. This engagement can create an additional seal between the support assembly 500 and the target object 106. The seal between the lid 502 and the target object 106 and the seal between the plug body 504 and the target object 106 can form an interior volume in the target object 106. In one embodiment, this interior volume is filled with a fluid, such as air, to provide support to the target object 106 during the printing operation. For example, the interior volume of the target object 106 can be pressurized to cause the exterior surface of the target object 106 to resist becoming indented or concave during the printing of the image on the target object 106.

Alternatively, the plug body 504 may engage the interior surface of the target object 106 to provide the support for preventing the exterior surface of the target object 106 from becoming concave during printing on the target object 106. For example, instead of pressurizing the interior volume of the target object 106 to support the exterior surface of the target object 106 from within, the plug body 504 may mechanically support the exterior surface of the target object 106, such as by engaging the interior surface of the target object 106 on an opposite side of the portion of the exterior surface that is printed upon.

Figure 8:
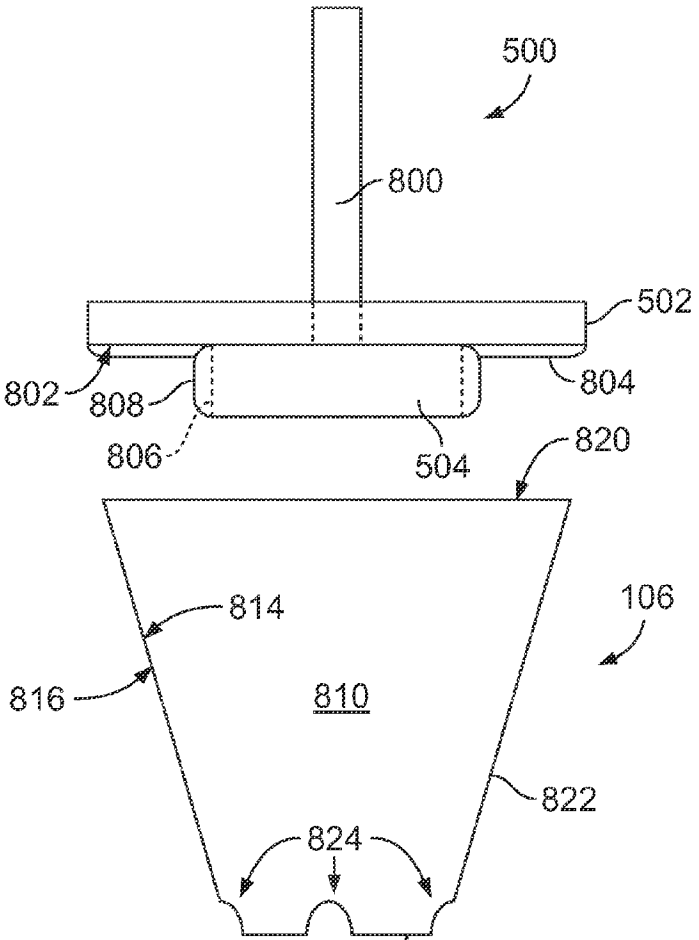
FIG. 8 illustrates a schematic diagram of the support assembly prior to engagement with the target object in accordance with one example.

FIG. 8 illustrates a schematic diagram of the support assembly 500 prior to engagement with the target object 106 in accordance with one example. The support assembly 500 includes a piston 800 that is coupled with the plug body 504 and that extends through the lid 502. The piston 800 may move relative to the lid 502 in order to move the plug body 504 away from the lid 502. For example, the piston 800 may be actuated to move in a downward direction in the perspective of FIG. 8 and cause the plug body 504 to separate from the lid 502. When the plug body 504 is separated from the lid 502, the piston 800 may move in an opposite direction to retract the plug body 504 toward the lid 502. In the illustrated embodiment, prior to the lid 502 engaging the target object 106, the plug body 504 is coupled to the lid 502. Alternatively, the plug body 504 may be spaced apart from the lid 502.

The lid 502 has a sealing surface 802 that faces the target object 106. The sealing surface 802 may include or be coupled with a deformable body 804. The deformable body 804 may include silicone or another material that can create a seal with the target object 106 when the lid 502 engages the target object 106. The plug body 504 also includes a sealing surface 806 that includes or is coupled with a deformable body 808, such as silicone or another material that can create a seal with the target object 106. The sealing surface 806 faces the interior surface of the target object 106 when the plug body 504 is positioned inside the target object 106.

The plug body 504 may be at least partially hollow to define an interior chamber within the plug body 504. The interior chamber can be at least partially bounded by the deformable body 808. For example, the interior chamber of the plug body 504 may be located between the sealing surface 806 and the deformable body 808. Alternatively, the interior chamber of the plug body 504 may extend into the plug body 504 (e.g., between portions of the sealing surface 806 on opposite sides of the plug body 504).

The target object 106 includes a hollow interior volume 810 that is at least partially bounded by a lower surface 812 and a wall 822 of the target object 106. The wall 822 has the interior surface 814 and the opposite exterior surface 816 of the target object 106. The wall 822 extends from the lower surface 812 to an upper edge 820 of the target object 106. The interior volume 810 may be open at the upper edge 820. For example, the upper edge 820 may define an opening into the interior volume 810 of the target object 106.

In the illustrated embodiment, the target object 106 forms a container having an open top, such as a pot. In one embodiment, the target object 106 may include one or more holes or openings 824 extending through the wall 822. Such holes or openings 824 may be provided for an eventual end use of the target object 106, such as drainage holes for a flower pot. Alternatively or additionally, the holes or openings 824 may be remnants of the manufacturing process used to form the target object 106.

Figure 9:
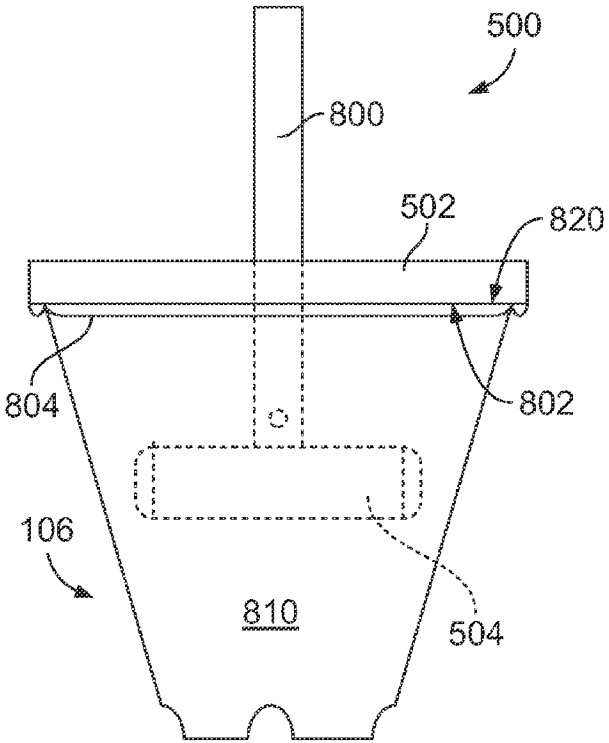
FIG. 9 illustrates a schematic diagram of the support assembly coupled with the target object in accordance with one example.

FIG. 9 illustrates a schematic diagram of the support assembly 500 coupled with the target object 106 in accordance with one example. As described above, the support assembly 500 can be inserted into the interior volume 810 of the target object 106 and/or the target object 106 can be lifted up to the support assembly 500. In one embodiment, the support assembly 500 is loaded into the target object 106 and/or the target object 106 is raised toward the lid 502 of the support assembly 500 until the lid 502 engages the upper edge 820 of the target object 106. The deformable body 804 and/or sealing surface 802 of the lid 502 can engage the upper edge 820 of the target object 106 to form a seal. This seal may prevent or significantly reduce the flow of gas and/or liquid between the lid 502 and the upper edge 820 of the target object 106.

The piston 800 may be actuated to separate the plug body 504 from the lid 502 and to move the plug body 504 further into the interior volume 810 of the target object 106. In one embodiment, the piston 800 may be pneumatically actuated to move through the lid 502 (e.g., through a channel extending through the lid 502) and to separate the plug body 504 from the lid 502. Alternatively, the piston 800 may be moved using a motor, such as a stepper motor. In another embodiment, another mechanism can be used to move the piston 800 to separate the plug body 504 from the lid 502. In another embodiment, the plug body 504 is already separated from the lid 502 such that the piston 800 does not need to move to separate the plug body 504 from the lid 502.

Figure 10:
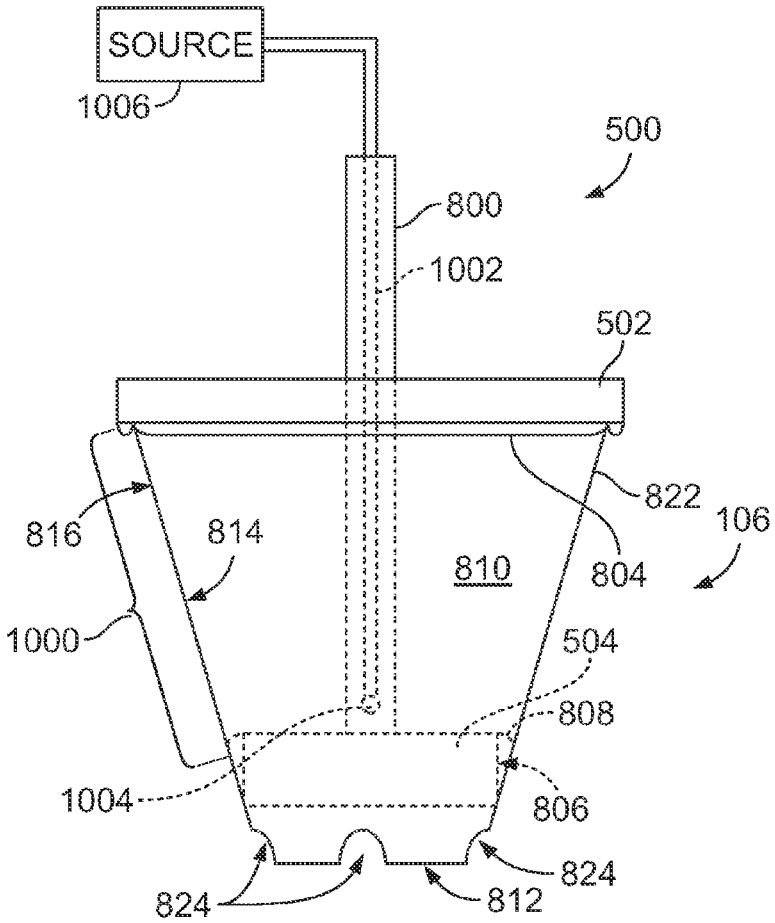
FIG. 10 illustrates a schematic diagram of the lid and the plug body of the support assembly coupled with the target object in accordance with one example.

FIG. 10 illustrates a schematic diagram of the lid 502 and the plug body 504 of the support assembly 500 coupled with the target object 106 in accordance with one example. The piston 800 can continue to move the plug body 504 in the interior volume 810 of the target object 106 and away from the lid 502 until the plug body 504 engages the interior surface 814 of the target object 106. For example, the piston 800 can move the plug body 504 until the deformable body 808 on the sealing surface 806 engages the interior surface 814 of the target object 106. In one embodiment, the interior chamber of the plug body 504 may be at least partially inflated (e.g., with a liquid or gas, such as air) to cause the deformable body 808 to expand or otherwise inflate. This expansion of the deformable body 808 assists in creating a seal between the plug body 504 and the interior surface 814 of the target object 106. In another embodiment where the plug body 504 does not include the sealing surface 806, the plug body 504 may be moved until the sealing surface 806 engages the interior surface 814. The deformable body 808 and/or sealing surface 804 of the plug body 504 can engage the interior surface 814 of the target object 106 to form the seal.

The seals formed by the lid 502 and the plug body 504 can define a sealed chamber 1000 inside the target object 106. This sealed chamber 1000 is bounded by the lid 502 (or the deformable body 804 and/or the lid 502), the plug body 504 (or the deformable body 808 and/or the plug body 504), and the interior surface 814 of the target body 106 in the illustrated embodiment. The sealed chamber 1000 may be located so as to be located opposite of the portion of the exterior surface 816 that is printed on in the system 100 (shown in FIG. 1). For example, the portion of the exterior surface 816 that receives the image from the web 108 (shown in FIG. 1) may be located on an opposite side of the wall 822 as the sealed chamber 1000.

In the illustrated embodiment, the seal between the plug body 504 and the interior surface 814 of the target object 106 is created in a location away from the holes or openings 824 in the target object 106, such as above the holes or openings 824. For example, the plug body 504 may form a seal with the interior surface 814 of the target object 106 in a location that prevents the holes or openings 824 from providing access to the sealed chamber 1000. In another embodiment where the target object 106 does not include the holes or openings 824, the support assembly 500 may not include the plug body 504. For example, the support assembly 500 may include the lid 502 that engages the upper edge 820 of the target object 106 to form the sealed chamber 1000 that is bounded by the lid 502, the wall 822 of the target object 106, and the lower surface 812 of the target object 106. The sealed chamber 1000 may be sealed from the surrounding atmosphere (e.g., the air around and outside of the sealed chamber 1000) such that fluid (e.g., gas and/or liquid) cannot flow out of the sealed chamber 1000 or into the sealed chamber 1000.

The system 100 pressurizes the sealed chamber 1000 by filling or at least partially filling the sealed chamber 1000 with a pressurizing fluid. For example, the system 100 may fill the sealed chamber 1000 with a gas, such as air. In one embodiment, the system 100 can fill the sealed chamber 1000 such that the pressure inside the sealed chamber 1000 is at least as great as, or greater than, the pressure outside of the sealed chamber 1000. For example, the pressure inside the sealed chamber 1000 may be at least as great as atmospheric pressure. The pressure inside the sealed chamber 1000 is sufficiently large to prevent indentation or a changing of shape of the exterior surface 816 of the target object 106 during printing on the exterior surface 816. Alternatively, the pressure inside the sealed chamber 1000 may be less than atmospheric pressure but sufficiently large to prevent indentation of the exterior surface 816 of the target object 106 during printing of the image on the exterior surface 816. Preventing the exterior surface 816 from indenting or changing shape (e.g., becoming more concave) during the printing on the exterior surface 816 can ensure that the image is properly applied to the exterior surface 816 (e.g., the complete image is applied in a designated location without smearing, ripping, or otherwise damaging the image).

Figure 11:
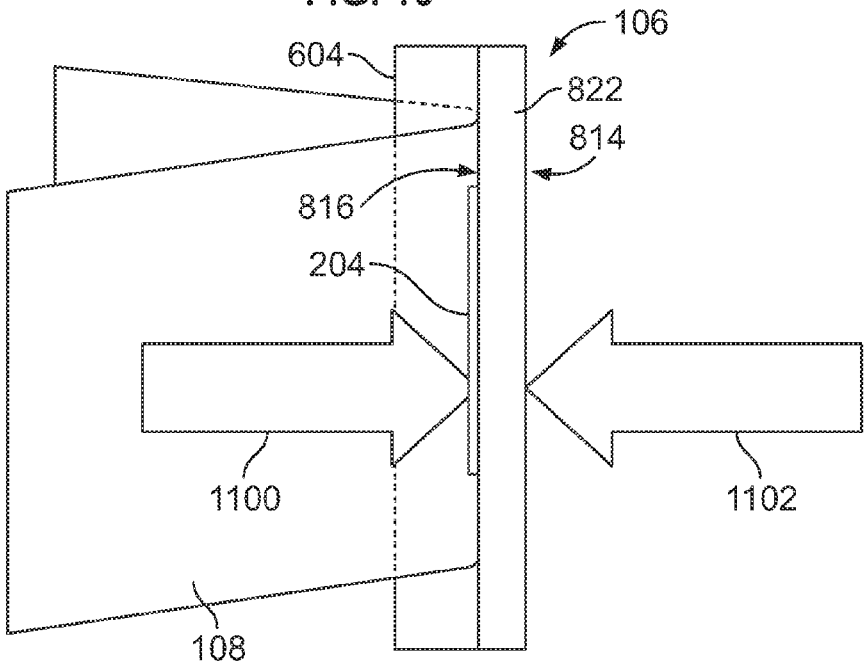
FIG. 11 is a schematic diagram of an example of applying an image to an exterior surface of the target object.

FIG. 11 is a schematic diagram of an example of applying the image 204 to the exterior surface 816 of the target object 106. Only the portion of the wall 822 of the target object 106 that is printed upon is shown in FIG. 11. When the web 108 is brought close to and/or in contact with the exterior surface 816 of the target object 106 by the applicator device 604, an application force 1100 may be imparted onto the exterior surface 816 by the applicator device 604. This application force 1100 is generally oriented toward the exterior surface 816. The wall 822 of the target object 106 may not have sufficient strength or rigidity to prevent the application force 1100 from bending, indenting, or otherwise making the wall 822 concave. The pressurizing of the sealed chamber 1000 (shown in FIG. 10) with a fluid, however, provides support from the inside of the target object 106. This interior support may be represented by a resistive force 1102. As shown in FIG. 11, the resistive force 1102 may oppose (e.g., be oriented opposite of) the application force 1100. The resistive force 1102 may increase responsive to the pressure inside the sealed chamber 1000 increasing (and decrease responsive to the pressure decreasing). The resistive force 1102 supports the wall 822 and prevents the wall 822 from changing shape when the image 204 is applied to the exterior surface 816 of the wall 822.

Returning to the discussion of the support assembly 500 shown in FIG. 10, in the illustrated embodiment, the system 100 fills the sealed chamber 1000 with a pressurizing fluid via a conduit 1002 and orifice 1004 of the support assembly 500. Alternatively, a conduit and orifice that are separate from the support assembly 500 may be used. The conduit 1002 shown in FIG. 10 extends through the piston 800 to the orifice 1004 that is disposed between the lid 502 and the plug body 504. The conduit 1002 is fluidly coupled with the sealed chamber 1000 via the orifice 1004. The conduit 1002 also is fluidly coupled with a source 1006 of pressurizing fluid, such as a compressor, gas tank, liquid tank, pump, or the like. The source 1006 provides the pressurizing fluid to the sealed chamber 1000 via the conduit 1002 and the orifice 1004. The source 1006 may be automatically or manually controlled by the control unit 104 (shown in FIG. 1) to control the amount of fluid used to pressurize the sealed chamber 1000.

Once the image is printed on the target object 106, the piston 800 may actuate to retract the plug body 504 toward the lid 502. The piston 800 also may remove the lid 502 from the target object 106 such that the support assembly 500 is removed from the target object 106. Decoupling the lid 502 or plug body 504 from engagement with the target object 106 can break the seals between the lid 502 and the target object 106 and between the plug body 504 and the target object 106. Breaking these seals opens the sealed chamber 1000 such that the sealed chamber 1000 is opened. The pressurizing fluid in the sealed chamber 1000 may escape such that the pressure inside the target object 106 equalizes with the surrounding atmosphere. The target object 106 having the image printed on the exterior surface 816 may then be moved by the conveyance assembly 112 (shown in FIG. 1) away from the support assembly 500, such as by moving the target object 106 toward the outlet of the system 100. Another target object 106 may be positioned at or below the support assembly 500 so that the support assembly 500 may support the target object 106 from within during printing on the target object 106, as described above.

Figure 12:
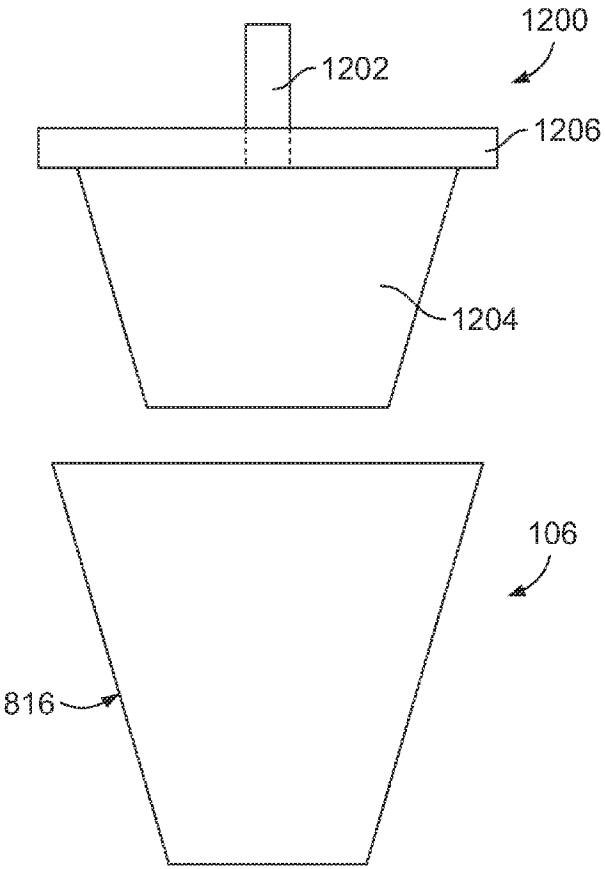
FIG. 12 illustrates a schematic diagram of a support assembly in accordance with another example.

FIG. 12 illustrates a schematic diagram of a support assembly 1200 in accordance with another example. The support assembly 1200 may be used in place of the support assembly 500 (shown in FIG. 5) to support the target object 106 from within during printing of an image on the exterior surface 816 of the target object 106. The support assembly 1200 includes a piston 1202 that is coupled with a plug body 1204 and that extends through a lid 1206 of the support assembly 1200. Similar to the piston 800 (shown in FIG. 8) of the support assembly 500, the piston 1202 may move relative to the lid 1206 in order to move the plug body 1204 away from the lid 1206. When the plug body 1204 is separated from the lid 1206, the piston 1202 may move in an opposite direction to retract the plug body 1204 toward the lid 1206.

Figure 13:
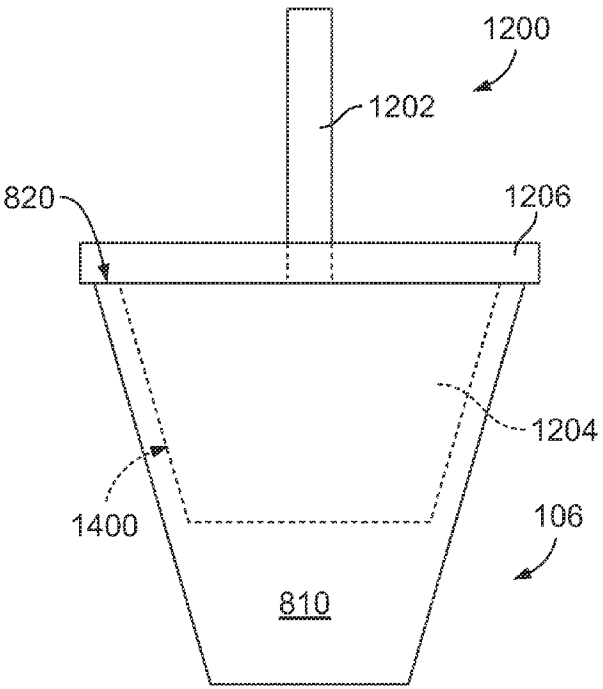
FIG. 13 illustrates a schematic diagram of the support assembly shown in FIG. 12 coupled with the target object in accordance with one example.

FIG. 13 illustrates a schematic diagram of the support assembly 1200 coupled with the target object 106 in accordance with one example. In one embodiment, the support assembly 1200 is loaded into the target object 106 and/or the target object 106 is raised toward the lid 1206 of the support assembly 1200 until the lid 1206 engages the upper edge 820 of the target object 106. The piston 1202 may be actuated to separate the plug body 1204 from the lid 1206 and to move the plug body 1204 further into the interior volume 810 of the target object 106.

Figure 14:
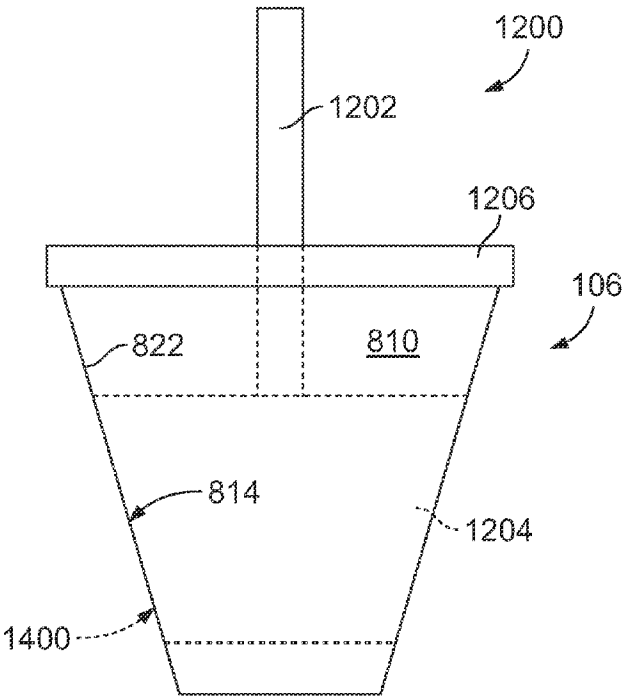
FIG. 14 illustrates a schematic diagram of a lid and a plug body of the support assembly shown in FIG. 12 coupled with the target object in accordance with one example.

FIG. 14 illustrates a schematic diagram of the lid 1206 and the plug body 1204 of the support assembly 1200 coupled with the target object 106 in accordance with one example. The piston 1202 can continue to move the plug body 1204 in the interior volume 810 of the target object 106 and away from the lid 1206 until the plug body 1204 engages the interior surface 814 of the target object 106. For example, the piston 1202 can move the plug body 1204 until an exterior sealing surface 1400 of the plug body 1204 engages the interior surface 814 of the target object 106.

The engagement between the plug body 1204 and the interior surface 814 of the target object 106 provides support from the inside of the target object 106. This interior support can provides the resistive force 1102 that opposes the application force 1100 of printing the image on the target object 106, as described above in connection with FIG. 11. The resistive force 1102 provided by the plug body 1204 supports the wall 822 and prevents the wall 822 from changing shape when the image 204 is applied to the exterior surface 816 of the wall 822. Once printing is complete, the piston 1202 may retract the plug body 1204 and the lid 1206 from the target object 106. The target object 106 may be moved away from the support assembly 1200 so that another target object 106 may be supported from within by the supporting assembly 1200.

Figure 15:
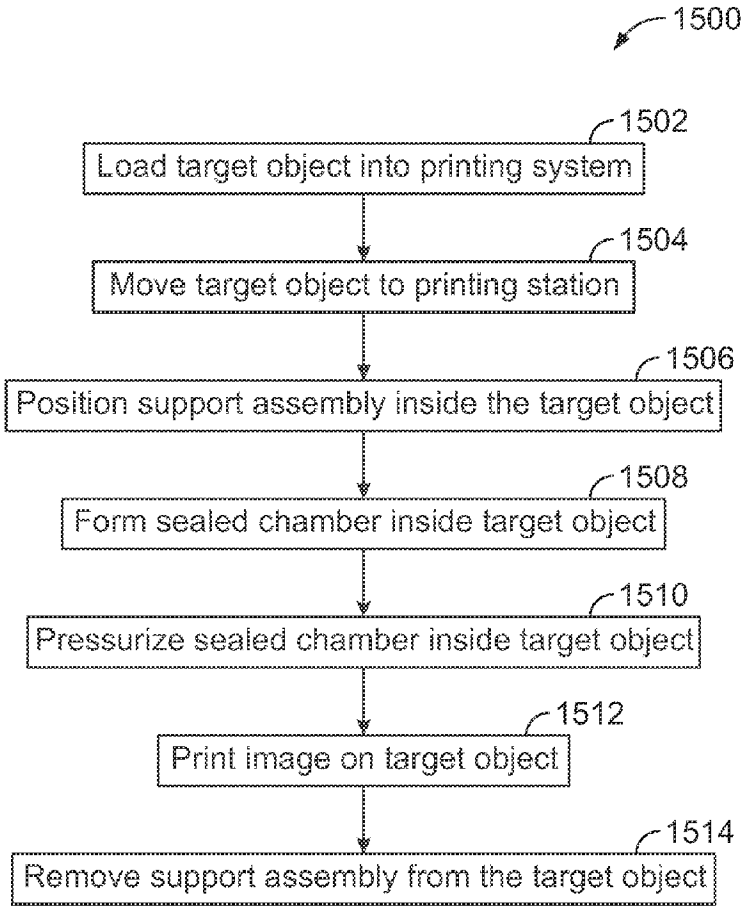
FIG. 15 is a flowchart of one embodiment of a method for providing interior support to a target object during printing on the target object.

FIG. 15 is a flowchart of one embodiment of a method 1500 for providing interior support to a target object during printing on the target object. The method 1500 may be used in conjunction with one or more embodiments of the system 100

(shown in FIG. 1) described above. For example, the method 1500 may be used to provide interior support to the target object 106 (shown in FIG. 1) during heat transfer printing (or other printing) onto the target object 106.

At 1502, the target object is loaded into the system. For example, the target object 106 may be manually or automatically placed into the system 100 through the inlet 110 (shown in FIG. 1) of the system 100.

At 1504, the target object is moved to a printing station of the system. For example, the conveyance assembly 112 (shown in FIG. 1) may move the target object 106 through the system 100 to the printing station 400 (shown in FIG. 4). In one embodiment, the conveyance assembly 112 may move the target object 106 to one or more pre-treatment stations for modifying the target object 106 prior to printing, such as by heating the target object 106.

At 1506, a support assembly is positioned inside the target object. For example, the support assembly 500 (shown in FIG. 5) may be positioned inside the target object 106 by lifting the target object 106 toward the support assembly 500 and/or lowering the support assembly 500 at least partially into the target object 106. A seal may be formed between the support assembly 500 and the target object 106, such as by the lid 502 (shown in FIG. 5) of the support assembly 500 engaging the edge 820 (shown in FIG. 8) of the target object 106.

At 1508, a sealed chamber is formed inside the target object. For example, the sealed chamber 1000 (shown in FIG. 10) may be formed inside the target object 106 by creating a seal between the lid 502 and the target object 106 and a seal between the plug body 504 (shown in FIG. 5) of the support assembly 500 and the target object 106.

At 1510, the sealed chamber is pressurized. For example, a fluid (e.g., a gas and/or liquid) may be directed into the sealed chamber 1000 in the target object 106 to increase a pressure inside the sealed chamber 1000. The increased pressure in the sealed chamber 1000 can provide structural support to the target object 106 during printing, as described above.

At 1512, an image is printed on the target object. The image may be printed on an exterior surface of the target object 106. The pressurized chamber 1000 inside the target object 106 resists the printing operation changing the shape of the exterior surface 814 (shown in FIG. 8) of the target object 106, as described above.

At 1514, the support assembly is removed from the target object. For example, the target object 106 may be lowered from the support assembly 500 and/or the support assembly 500 may be lifted from the target object 106. The target object 106 may then be moved away from the printing station 400, such as by the conveyance assembly 112, toward the outlet 114 (shown in FIG. 1) of the system 100 where the target object 106 may be removed from the system 100. Another target object 106 may then be positioned in the printing station 400 for printing, as described above.

In another embodiment, a support assembly includes a lid, a plug body, and a conduit. The lid is configured to engage a target object having an exterior surface on which an image is to be printed. The plug body is coupled with the lid and configured to be disposed in an interior volume of the target object when the lid is engaged with the target object. The plug body also is configured to engage an interior surface of the target object to form a sealed chamber inside the target object when the lid engages the target body. The conduit extends through the lid to an orifice disposed between the lid and the plug body. The conduit is configured to deliver a pressurizing fluid into the sealed chamber in order to increase a pressure inside the sealed chamber in the target object. The pressure inside the sealed chamber provides a resistive force that prevents the exterior surface of the target object from changing shape when the image is printed on the exterior surface of the target object.

In one aspect, the target object is a hollow object.

In one aspect, the lid is configured to engage an edge of an opening into the interior volume of the target object.

In one aspect, the plug body is configured to be spaced apart from the lid when the lid engages the target object and the plug body engages the interior surface of the target object.

In one aspect, the sealed chamber extends from the lid to the plug body and is bounded by the interior surface of the target object between the lid and the plug body.

In one aspect, the assembly also includes a piston coupled to the plug body and configured to move through the lid to move the plug body relative to the lid. The piston also is configured to move the plug body away from the lid when the lid engages the target object to a location inside the interior volume of the target object such that the plug body engages the interior surface of the target object.

In one aspect, the assembly also includes a piston coupling the lid with the plug body and the conduit is disposed inside the piston.

In one aspect, the target object includes plural openings that provide access to the interior volume of the target object. The lid and the plug body are configured to engage the target object such that the openings do not provide access to the sealed chamber.

In one aspect, the image is printed on the exterior surface of the target object using heat transfer printing.

In another embodiment, a method (e.g., for providing interior support to a hollow object being printed on) includes receiving a target object having an exterior surface on which an image is to be printed, inserting an interior support assembly into an interior volume of the target object until the interior support assembly engages the target object in a plurality of locations to form a sealed chamber inside the target object, and delivering a pressurizing fluid into the sealed chamber inside the target object in order to increase a pressure inside the sealed chamber. The pressure inside the sealed chamber provides a resistive force that prevents the exterior surface of the target object from changing shape when the image is printed on the exterior surface of the target object.

In one aspect, the target object is a hollow object.

In one aspect, inserting the interior support assembly includes engaging a lid of the interior support assembly with an edge of an opening into the interior volume of the target object.

In one aspect, inserting the interior support assembly includes forming seals between the interior support assembly and the target object at the plurality of locations where the interior support assembly engages the target object.

In one aspect, the sealed chamber extends from a lid of the interior support assembly to a plug body of the interior support assembly. The lid is engaged with the target object along a periphery of an opening into the interior chamber of the target object. The plug body is engaged with an interior surface of the target object in the interior volume.

In one aspect, the target object includes plural openings that provide access to the interior volume of the target object. Inserting the interior support assembly includes engaging the target object at the plurality of locations to form the sealed chamber such that the openings do not provide access to the sealed chamber.

In one aspect, the method also includes printing the image on the exterior surface of the target object using heat transfer printing.

In another embodiment, a support assembly includes a lid, a piston, and a plug body. The lid is configured to engage a target object having an interior volume that is at least partially enclosed by a wall of the target object. The piston is coupled with the lid. The plug body is coupled with the lid by the piston and is configured to engage an interior surface of the wall of the target object inside the interior volume. At least one of the lid or the plug body is used to create a resistive force on the wall of the target object that prevents a shape of the wall from changing during printing of an image on an exterior surface of the wall.

In one aspect, the lid is configured to engage a target object to form a first seal between the lid and the target object and the plug body is configured to engage the interior surface of the wall of the target object inside the interior volume to form a second seal between the plug body and the target object. The lid and the plug body are used to create the resistive force by forming a sealed chamber inside the interior volume of the target object using the first seal and the second seal. The sealed chamber is configured to be pressurized with a fluid to impart the resistive force on the wall of the target object.

In one aspect, the plug body is configured to engage the interior surface of the wall of the target object inside the interior volume to create the resistive force by preventing an opposing application force exerted on the exterior surface of the wall from deforming the wall.

In one aspect, the piston is configured to move the plug body away from the lid such that the plug body engages the interior surface of the target body away from the lid.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A support assembly comprising:

a lid with a first deformable body configured to engage a target object having an exterior surface on which an image is to be printed;

a plug body with a second deformable body coupled with and spaced apart from the lid, the plug body configured to be disposed in an interior volume of the target object when the lid is engaged with the target object, the plug body configured to engage an interior surface of the target object;

a sealed chamber disposed inside the target object, the sealed chamber defined and bounded by the lid, the interior surface of the target object, and the plug body when the first deformable body and the second deformable body form seals with the target body at the same time;

a conduit extending through the lid to an orifice disposed within the sealed chamber between the lid and the plug body, the conduit configured to deliver a pressurizing fluid into the sealed chamber in order to increase a pressure inside the sealed chamber in the target object, wherein the pressure inside the sealed chamber provides a resistive force that prevents the exterior surface of the target object from changing shape when the image is printed on the exterior surface of the target object; and a piston coupled to the plug body and configured to move through the lid to move the plug body relative to the lid, wherein the piston is configured to move the plug body away from the lid when the lid engages the target object to a location inside the interior volume of the target object such that the plug body engages the interior surface of the target object.

2. The support assembly of claim 1, wherein the target object is a hollow object.

3. The support assembly of claim 1, wherein the lid is configured to engage an edge of an opening into the interior volume of the target object.

4. The support assembly of claim 1, wherein the plug body is configured to be spaced apart from the lid when the lid engages the target object and the plug body engages the interior surface of the target object.

5. The support assembly of claim 4, wherein the sealed chamber extends from the lid to the plug body and is bounded by the interior surface of the target object between the lid and the plug body.

6. The support assembly of claim 1, further comprising a piston coupling the lid with the plug body, wherein the conduit is disposed within the piston.

7. The support assembly of claim 1, wherein the target object includes plural openings that provide access to the interior volume of the target object, and the lid and the plug body are configured to engage the target object such that the openings do not provide access to the sealed chamber.

8. The support assembly of claim 1, wherein the image is printed on the exterior surface of the target object using heat transfer printing.

9. A method comprising:

receiving a target object having an exterior surface on which an image is to be printed, the target object having an edge of an opening of the target object and an interior surface that extends around an interior volume of the target object;

coupling a lid of an interior support assembly to the upper edge of the target object;

extending a plug body of the interior support assembly into the interior volume of the target object until the plug body engages the interior surface of the target object in a plurality of locations to form a sealed chamber inside the target object, the sealed chamber defined and bounded by the lid of the interior support assembly, the interior surface of the target object, and the plug body of the interior support assembly;

delivering a pressurizing fluid into the sealed chamber inside the target object in order to increase a pressure inside the sealed chamber, wherein the pressure inside the sealed chamber provides a resistive force that prevents the exterior surface of the target object from changing shape when the image is printed on the exterior surface of the target object; and providing a piston coupled to the plug body and configured to move through the lid to move the plug body relative to the lid, wherein the piston is configured to move the plug body away from the lid when the lid engages the target object to a location inside the interior volume of the target object such that the plug body engages the interior surface of the target object.

10. The method of claim 9, wherein the target object is a hollow object.

11. The method of claim 9, wherein extending the plug body of the interior support assembly into the interior volume of the target body includes forming seals between the plug body and the target object at the plurality of locations where the plug body engages the interior surface of the target object.

12. The method of claim 11, wherein the sealed chamber extends from the lid of the interior support assembly to the plug body of the interior support assembly, the lid engaged with the target object along a periphery of the opening into the interior chamber of the target object, the plug body engaged with the interior surface of the target object in the interior volume.

13. The method of claim 9, wherein the target object includes plural openings that provide access to the interior volume of the target object, and inserting the plug body of the interior support assembly includes engaging the target object at the plurality of locations to form the sealed chamber such that the openings do not provide access to the sealed chamber.

14. The method of claim 9, further comprising printing the image on the exterior surface of the target object using heat transfer printing.

15. A support assembly comprising:

a lid with a first deformable body configured to engage a target object having an interior volume that is at least partially enclosed by a wall of the target object;

a piston coupled with the lid; and a plug body with a second deformable body coupled with the lid by the piston, the plug body configured to engage an interior surface of the wall of the target object inside the interior volume; and a sealed chamber disposed inside the target object, the sealed chamber defined and bounded by the lid, the interior surface of the target object, and the plug body when the first and second deformable bodies form seals with the target object at the same time, wherein the sealed chamber creates a resistive force on the wall of the target object that prevents a shape of the wall from changing during printing of an image on an exterior surface of the wall, wherein the piston is configured to move the plug body away from the lid such that the plug body engages the interior surface of the target body away from the lid.

16. The support assembly of claim 15, wherein the lid is configured to engage a target object to form a first seal between the lid and the target object and the plug body is configured to engage the interior surface of the wall of the target object inside the interior volume to form a second seal between the plug body and the target object, and wherein the sealed chamber is configured to be pressurized with a fluid to impart the resistive force on the wall of the target object.

17. The method of claim 9, wherein delivering the pressurizing fluid into the sealed chamber increases the pressure inside the sealed chamber above pressure that is outside of the sealed chamber.

* * * * *